United States Patent [19]

Labate

[11] Patent Number: 4,586,956

[45] Date of Patent: May 6, 1986

[54] METHOD AND AGENTS FOR PRODUCING CLEAN STEEL

[76] Inventor: Micheal D. Labate, 115 Hazen Ave., Ellwood City, Pa. 16117

[21] Appl. No.: 755,724

[22] Filed: Jul. 17, 1985

[51] Int. Cl.[4] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 2,221,784 | 11/1940 | Critchett | 75/58 |
| 4,036,635 | 7/1977 | Klapdar | 75/58 |
| 4,238,227 | 12/1980 | Golas | 75/58 |
| 4,341,554 | 7/1982 | Kuros | 75/58 |
| 4,490,173 | 12/1984 | Schwer | 75/58 |

*Primary Examiner*—Peter D. Rosenberg
*Attorney, Agent, or Firm*—Harpman & Harpman

[57] ABSTRACT

A method for producing exceptionally clean steel wherein desulphurization agents are added to the tap ladle during the first one-third volume of steel tapped and then adding a reduced amount of a deoxidizing agent and then adding slag conditioner agents when one-half of the volume of steel is tapped and then adding an expandable ladle cover compound when substantially two-thirds of the volume of steel is tapped. Argon is then blown through the steel at a rate sufficient to create a bubbling action and finally a deoxidizing agent is added when the final volume of steel has been tapped.

6 Claims, No Drawings

METHOD AND AGENTS FOR PRODUCING CLEAN STEEL

BACKGROUND OF THE INVENTION

1. Technical Field:

This invention relates to a method and agents for producing exceptionally clean steel for continuous casting and the like.

2. Description of the Prior Art:

The prior art methods and agents heretofore used for the cleansing of steel of non-metallic inclusions are represented by U.S. Pat. Nos. 2,221,784, 4,036,635, 4,217,134, 4,238,227 and 4,290,173.

U.S. Pat. No. 2,221,784 discloses the use of additive agents containing silicon, calcium, aluminum and at least one metal selected from the group consisting of titanium and zirconium, the additive being added to the molten steel in the ladle.

U.S. Pat. No. 4,036,635 discloses a steel melt formed under an iron oxide containing slag held back while the steel melt is tapped and subjected to deoxidation with silicon or aluminum plus an after treatment with a calcium containing substance such as calcium silicon or calcium carbide.

U.S. Pat. No. 4,217,134 discloses the use of compositions comprising lime, fluorspar, and ground aluminum used in a method of desulphurizing molten steel by adding the compositions to the steel in the ladle or injecting the composition in particulate form into the molten steel.

U.S. Pat. No. 4,238,227 discloses the use of a high amount of aluminum added to the tap ladle before the first one-third volume of steel is tapped and then adding conventional deoxidizers while the final two-thirds volume of steel is tapped. Argon gas is subsequently blown through the steel.

U.S. Pat. No. 4,490,173 discloses the use of additive compositions for flux solubilization, desulphurization and the removal of inclusions. The additive composition includes lime and a compound selected from the group consisting of bauxite and mixtures of calcium alimunate and bauxite.

The present invention eliminates the several problems generally associated with the prior art methods and additives used in attempting to produce a clean steel particularly suited for use in a continuous caster and incidentally reduces the amount of aluminum as a deoxidizing agent to approximately one-half of the amount theretofore believed necessary.

SUMMARY OF THE INVENTION

A method and agents for producing exceptionally clean steel results in floating all available non-metallic inclusions to the surface of the steel being treated in a ladle where they engage and are absorbed by a ladle covering compound, as disclosed in my U.S. Pat. No. 4,462,834, which contains burnt lime, aluminum dross, fluorspar, and acid treated graphite. The method begins when the steel is first poured into the ladle from the source, such as a converter, electric furnace, etc., at which time a desulphurizing composition is added simultaneously with the molten steel; the desulphurizing material comprising calcium fluoride, sodium carbonate, and calcium hydroxide, followed by the addition of a deoxidizing agent when about one-third of the volume of steel has been added to the ladle, the deoxidizing agent comprising metallic aluminum; this is followed by the addition of a slag conditioning composition when the ladle is approximately one-half full, the slag conditioning composition comprising calcium oxide and calcium and aluminum in an alloy including a small percentage of magnesium, adding an expandable ladle cover and immediately followed by the introduction of Argon gas into the lower portion of the melt in sufficient volume and at a rate of introduction sufficient to cause desirable turbulence in the molten metal comprising the melt. The final step in the method is the addition of a final deoxidizing additive comprising metallic aluminum. The total amount of metallic aluminum as deoxidizing agents introduced in separate and distinct steps is approximately one-half the amount of metallic aluminum heretofore believed necessary in deoxidizing molten steel.

DESCRIPTION OF THE PREFERRED EMBODIMENT

Those skilled in the art relating to producing steel will recognize the desirable results of the present invention which provides exceptionally clean steel which may be any grade of steel with the least non-metallic content. The method is preferably practiced in a ladle to which molten steel from a conventional source, such as a converter, electric furance and the like, is tapped. The ladle may be of any size from 30 tons to 300 tons capacity and the steel introduced into the ladle may be at 3000° F. or it may vary 200° F. either way.

The first step of the method disclosed herein comprises the positioning in the ladle of a desulphurizing agent comprising a first additive compound consisting of equal amounts of calcium fluoride, sodium carbonate, and calcium hydroxide followed by the introduction of molten steel into the ladle or alternately adding the first additive compound to the first steel introduced into the ladle. The second step in the method is performed when the ladle is half full of molten steel and comprises the introduction of a second additive consisting of one-half of the normal metallic aluminum addition used in deoxidizing steel together with the addition of a third additive comprising a slag conditioning compound consisting of equal amounts of calcium oxide and calcium and an aluminum alloy comprising 95% aluminum and 5% magnesium. The fourth step in the method comprises the addition of an expandable ladle cover which includes burnt lime, aluminum dross, fluorspar, and acid treated graphite which forms a slag-like layer on the molten metal for absorbing the non-metallic inclusions, simultaneously creating a stirring and/or similar desirable turbulence in the molten metal as by the injection of Argon gas through a bottom ladle plug replacement or a hollow refractory lance, the amount and rate of flow of the Argon gas being sufficient to result in the desired turbulence. The introduction of the metallic aluminum additive and the slag conditioning compound results in a chemical reaction that forces the aluminum to disperse to the ultimate degree without becoming alloyed to either the free floating molten refractory in the molten steel or any of the soluable non-metallics that have been liberated from their various alloys.

Those skilled in the art will observe that the non-metallic inclusions normally found in molten steel may be traced to the refractory material present as a liner in the converter, electric furnace, etc. and/or the ladle in which the molten metal is received.

Oxygen and sulphur in the molten metal are responsible for most of the non-metallic inclusions as sulphur is soluable in steel at all temperatures above the melting point and oxygen is present in steels which are not completely deoxidized. The oxidizers, such as aluminum, when added to the ladle form oxides with the dissolved oxygen in the steel. The introduction of the slag conditioning compound hereinbefore set forth and the expanding ladle cover as hereinbefore set forth together with the induced turbulence forces chemically and physical contact of all of the insoluable non-metallics and the free sulphur and free aluminum oxide to rise to the top of the steel in the ladle and contact and be absorbed in the expanding ladle cover compound. The expanding ladle cover compound herein referred to expands its volume between 50% and 100% and this expansion of volume results in the absorption of the non-metallics that are forced to the top of the molten steel by the induced turbulence.

The products absorbed by the expanding ladle cover compound are held in the cover compound until the molten steel is removed from the bottom of the ladle and they do not revert into the molten metal.

The materials in the first additive comprising the calcium fluroide, the sodium carbonate, and the calcium hydroxide are present in equal amounts, the amount of each ingredient being between 5 lbs. and 15 lbs. per ton of molten steel. The metallic aluminum added when the ladle is half full is approximately one-fourth the amount of aluminum used as a deoxidizer in the prior art. It is the usual practice of adding deoxidizers such as aluminum during tapping to control the amount of aluminum in direct portion to the steel's oxygen content. Since the oxygen content of the liquid steel is not usually measured, the aluminum addition is usually determined approximately in inverse proportion to the carbon content. A curve relating total product oxygen and carbon content of the liquid steel has been used to determine the optimum amount of aluminum needed to react with the particularly amount of oxygen at each carbon content, for example, molten steel having a carbon content of 0.10% is usually treated with 165 lbs. of aluminum per 100 tons of steel or approximately one and three-quarter lbs. per ton.

In practicing the present invention, the amount of metallic aluminum added to the ladle when the same is one-third full and after adding the desulphurizing compound may be an amount between three-quarter of a lb. and one and one-quarter lbs. per ton of molten steel.

The second additive compound comprising the slag conditioner which is added to the ladle immediately after the metallic aluminum or when the ladle is half full comprises the calcium oxide and calcium in equal amounts and wherein the amount of each of the ingredients is between 5 and 15 lbs. per ton of molten metal. The introduction of Argon gas in sufficient quantities and at a rate to create a desirable turbulence and/or stirring motion of the molten metal results in a chemical reaction that forces the metallic aluminum to disperse the ultimate degree without becoming alloyed to either the free floating molten refractory or any of the insoluable non-metallics that have been liberated from their various alloys in the steel.

Those skilled in the art will observe that the desulphurizer compound plus the slag conditioner and the metallic aluminum to which any other required alloys needed to meet the desired aim chemistry are all in the molten bath and the same is slag-free or contains a minimum amount of furnace slag and that the expanding ladle cover compound over the complete molten bath forces chemical and physical contact of all of the insoluable non-metallics and the free sulphur and the free metallic aluminum that are being subjected to the turbulence to rise to the top of the steel bath and come in contact and be absorbed by the expanding ladle cover compound.

Those skilled in the art will recognize that the cleansing of the steel requires time and temperature control as the additives cause a rapid heat loss over an extended period of time during the tapping cycle which is the time it takes for the furnace to discharge its molten metal into the receiving ladle.

The present invention enables a more accurate and complete control of the time of the cleaning cycle and therefore controls the temperature by preventing the otherwise rapid heat loss.

At a predetermined time and/or predetermined temperature, the ladle carrying the clean steel is moved to a trim station and a small additional quantity of metallic aluminum added as a final deoxidizing agent. The amount of the metallic aluminum finally added to the molten steel at the trim station is an amount substantially the same as that initially added and it will occur to those skilled in the art that the total of the metallic aluminum added in the two stages is approximately one-half the metallic aluminum heretofore used as deoxidizers in the cleansing of steel by the methods heretofore known in the art.

It will occur to those skilled in the art that the required turbulence and/or stirring of the molten steel may be readily achieved through the use of a gas introducing plug in the bottom of the ladle and/or through the use of a hollow lance arranged to discharge the gas at or adjacent its lower end and it will further occur to those skilled in the art that the additives including the desulphurizing material and the slag conditioning compound and the metallic aluminum may be introduced in small particle size along with the Argon gas.

Although but one embodiment of the present invention has been described in the foregoing specification, it will be apparent to those skilled in the art that various modifications may be made therein without departing from the spirit of the invention and having thus described my invention, what I claim is:

1. A process for treating molten steel to remove insoluble non-metallic inclusions, sulphur and aluminum oxide therefrom, which includes the steps of tapping a heat of molten steel into a ladle and sequentially adding a desulphurization compound consisting of equal parts of calcium fluoride, sodium carbonate, and calcium hydroxide, adding granular metallic aluminum as a deoxidizing reactant agent, adding equal parts of calcium oxide and an aluminum alloy, the major portion of which is aluminum and a minor portion magnesium, as a slag conditioning compound, adding burnt lime, aluminum dross, flurospar and acid treated graphite as an expandable ladle covering compound and injecting an inert gas sufficient to create turbulence and stirring motion in the molten steel and adding additional granular metallic aluminum, the desulphurization compound being added with the first volume of steel tapped into the ladle, the first mentioned deoxidizing reacting agent, and the slag condition compound being added when approximately one-half of the volume of steel is tapped into the ladle, the expandable ladle covering compound being added immediately thereafter and the second mentioned granular metallic aluminum as a deoxidizing reactant agent being added after the addition of the expandable ladle cover compound and before the full volume of steel is tapped into the ladle whereby said turbulence forces chemically and physical contact of all of said insoluble metallic inclusions and the free sulphur and free aluminum oxide to rise to the top of the ladle and be absorbed in the expandable ladle covering compound so that clean molten steel can be withdrawn from the ladle below said expandable ladle covering compound.

2. The process of claim 1 wherein the amount of the desulphizing compound consists of from 5 lbs. to 15 lbs. of calcium fluoride per ton of the total amount of molten steel to be treated, from 5 lbs. to 15 lbs. of sodium carbonate per ton of the total amount of molten steel to be treated and from 5 lbs. to 15 lbs. of calcium hydroxide per ton of the total amount of molten steel to be treated.

3. The process of claim 1 and wherein the amount of deoxidizing reactant agent of each of said additions is between about three-fourths of a lb. to about one and one-quarter lbs. per ton of the total amount of molten steel to be treated.

4. The process of claim 1 wherein the predetermined amount of the slag conditioning compound consists of between about 5 lbs. and about 30 lbs. per ton of the total amount of molten steel to be treated.

5. The process of claim 1 wherein the amount of the expandable ladle covering compound is between about 5 lbs. to about 15 lbs. per ton of the total amount of molten steel to be treated.

6. The process of claim 1 wherein the expandable ladle covering compound includes burnt lime in amounts between 56% and 60% by weight, aluminum dross including $Al_2O_3$ in amounts between 22% and 30% by weight, fluorspar in amounts between 7% and 9% by weight, and acid treated graphite in amounts between 1% and 4% by weight.

* * * * *